US005779939A

United States Patent [19]

Gerling et al.

[11] Patent Number: 5,779,939

[45] Date of Patent: Jul. 14, 1998

[54] CORROSION PREVENTING COMPOSITION COMPRISING LACTOBIONIC ACID AMIDES

[75] Inventors: Klaus-Guenter Gerling, Laatzen; Helge Rau, Burgdorf; Kornelia Wendler, Sehnde; Petra Schwarz, Hanover; Karlheinz Uhlig, Krefeld, all of Germany

[73] Assignee: Solvay Deutschland GmbH, Hanover, Germany

[21] Appl. No.: 600,613

[22] Filed: Feb. 13, 1996

[30] Foreign Application Priority Data

Feb. 13, 1995 [DE] Germany ..... 195 04 639.0

[51] Int. Cl.[6] ..... C23F 11/00; C23F 14/00; C09K 3/00

[52] U.S. Cl. ..... 252/392; 252/388; 252/390; 252/396; 252/148; 252/56 R; 422/12; 422/16; 422/17

[58] Field of Search ..... 252/388, 148, 252/56 R, 390, 392, 396; 422/12, 16, 17; 510/102, 264, 407

[56] References Cited

U.S. PATENT DOCUMENTS

| | | | |
|---|---|---|---|
| 2,752,334 | 6/1956 | Walton | 260/211 |
| 4,789,553 | 12/1988 | McIntyre et al. | 426/325 |
| 5,389,279 | 2/1995 | Au et al. | 252/108 |
| 5,401,426 | 3/1995 | Gerling et al. | 252/8.6 |
| 5,521,293 | 5/1996 | Vermeer et al. | 536/17.2 |

FOREIGN PATENT DOCUMENTS

| | | |
|---|---|---|
| 569869 | 11/1993 | European Pat. Off. . |
| 1155771 | 10/1963 | Germany . |

*Primary Examiner*—Sharon Gibson
*Assistant Examiner*—Deanna Baxam
*Attorney, Agent, or Firm*—Evenson, McKeown, Edwards & Lenahan

[57] ABSTRACT

Corrosion prevention compositions which contain lactobionic acid N-alkylamides, and further having a pH below 9.0, are described. In particular, lactobionic acid N-alkylamides in which the saturated or unsaturated alkyl group bonded via the amide function has a chain length of 8 to 18 carbon atoms show a good corrosion-inhibiting action. The use of lactobionic acid N-alkylamides in corrosion prevention compositions and metalworking compositions is also described.

6 Claims, No Drawings

CORROSION PREVENTING COMPOSITION COMPRISING LACTOBIONIC ACID AMIDES

BACKGROUND OF THE INVENTION

This invention relates to corrosion prevention compositions which comprise lactobionic acid N-alkylamides.

Corrosion prevention or inhibiting compositions are employed in many metalworking operations, such as, for example, cutting, grinding or drilling, in order to protect the worked metal objects from the formation of rust. Many conventional corrosion prevention compositions comprise sulfur-containing compounds, such as, for example, petroleum-sulfonates or alkylarylsulfonic acids, or nitrogen-containing compounds, such as, for example, secondary amines or alkanolamines. Sulfur-containing corrosion prevention compositions have the disadvantage that their active compounds are easily modified or degraded by sulfur-reducing microorganisms. With amine-containing corrosion prevention compositions, particularly those which comprise secondary amines, there is the possibility that nitrosamines, which constitute a health hazard and which have been formed beforehand by uncontrolled chemical reactions, will be released from them. Therefore there has remained a need for new corrosion preventing or inhibiting compositions which do not have these disadvantages of the prior art. It would be particularly advantageous to have an amine-free corrosion preventing composition comprising an active corrosion-inhibiting agent formed from regenerable raw materials. It would also be desirable from an environment protection point of view to have a corrosion preventing composition comprising an active corrosion inhibiting agent which is not harmful to the environment.

SUMMARY OF THE INVENTION

It is therefore an object of the invention to provide new metal corrosion inhibiting compositions.

Another object of the invention is to provide corrosion inhibiting compositions which are not subject to degradation by microorganisms.

A further object of the invention is to provide corrosion inhibiting compositions which do not release hazardous substances and are not harmful to the environment.

It is also an object of the invention to provide corrosion inhibiting compositions which can be formed from regenerable raw material sources.

These and other objects of the invention are achieved by providing a corrosion inhibiting composition comprising lactobionic acid N-alkylamides.

In accordance with preferred aspects of the invention the lactobionic acid N-alkylamides comprise saturated or partly unsaturated alkyl groups having a chain length of 8 to 18 carbon atoms bonded via the amide function, and/or can be obtained by reaction of lactobionic acid or a reactive lactobionic acid derivative with a fatty amine mixture.

DETAILED DESCRIPTION OF PREFERRED EMBODIMENTS

Surprisingly, it has now been found that lactobionic acid N-alkylamides have a corrosion-inhibiting action.

The invention thus relates to corrosion prevention compositions which comprise lactobionic acid N-alkylamides. The corrosion prevention compositions according to the invention preferably comprise lactobionic acid N-alkylamides in which the saturated or partly unsaturated alkyl radicals bonded via the amide function have a chain length of 8 to 18 carbon atoms.

Those corrosion prevention compositions which comprise lactobionic acid N-alkylamides which have been obtained by reaction of lactobionic acid or reactive lactobionic acid derivatives, preferably lactobionic acid lactone, with a primary fatty amine mixture are particularly preferred. In the context of the present invention, primary amines which contain an aliphatic radical corresponding to the aliphatic radical of a fatty acid are called "primary fatty amines". Fatty amines can be obtained industrially, for example, from fatty acids by first converting these into their nitrites, which are then reduced to amines. Fatty amine mixtures which are obtained from naturally occurring fatty acid mixtures are preferably employed. The content of unsaturated fatty amines in these fatty amine mixtures varies here between about 5 and 85% by weight.

The corrosion prevention compositions according to the invention particularly preferably comprise lactobionic acid N-alkylamides selected from the group consisting of lactobionic acid N-oleylamide, lactobionic acid N-coconut amide and lactobionic acid N-tallow amide. These particularly preferred lactobionic acid N-alkylamides can easily be prepared by reaction of lactobionic acid or a lactobionic acid derivative with the corresponding fatty amine mixtures. A fatty amine mixture which has been obtained from a fatty acid mixture originating from sunflower oil and/or soya oil is referred to as oleylamine. A corresponding fatty amine mixture originating from coconut fat is called coconut fatty amine, and a corresponding fatty amine mixture originating from tallow is called tallow amine. In addition to saturated fatty amines, a certain content of unsaturated fatty amines is always present in these naturally occurring fatty amine mixtures. Oleylamine obtained from sunflower oil comprises, for example, about 14% by weight of saturated fatty amines having 12 to 18 carbon atoms and about 85% by weight of unsaturated fatty amines having 14 to 18 carbon atoms. Oleylamine obtained from soya oil (also called soya amine) comprises, for example, about 16% by weight of saturated $C_{16}$-fatty amines, about 15% by weight of saturated $C_{18}$-fatty amines and a content of about 63% by weight of unsaturated fatty amines having 14 to 18 carbon atoms. Coconut fatty amine comprises, for example, about 50% by weight of saturated $C_{12}$-fatty amines, about 18% by weight of saturated $C_{14}$-fatty amines and a content of about 7% by weight of unsaturated $C_{18}$-fatty amines. Tallow amine comprises, for example, about 29% by weight of saturated $C_{16}$-fatty amines, about 23% by weight of saturated $C_{18}$-fatty amines and a content of about 42% by weight of unsaturated fatty amines having 14 to 18 carbon atoms.

Lactobionic acid (=4-(β-D-galacto)-D-gluconic acid) and lactobionic acid lactone and their preparation are already known. Lactobionic acid can be obtained, for example, by oxidation of lactose in a known manner.

The corrosion prevention composition according to the invention preferably comprises the lactobionic acid N-alkylamides in the form of an aqueous solution. The aqueous solutions of the lactobionic acid N-alkylamides can be employed here as corrosion prevention compositions by themselves or also as a mixture with other compounds. The content of lactobionic acid N-alkylamides, based on the aqueous solution, can be in the customary concentration range here for corrosion prevention compositions, advantageously in the concentration range from 0.1 to 20% by weight, preferably in the concentration range from 1 to 10% by weight. The pH of the aqueous corrosion prevention compositions should be below pH 9.0.

The corrosion prevention compositions according to the invention which comprise lactobionic acid N-alkylamides in an aqueous solution can be completely clear solutions or, especially if other compounds are present, finely divided emulsions, which can be transparent, opaque or also milky-cloudy.

In addition to lactobionic acid N-alkylamides, the corrosion prevention compositions according to the invention can comprise all the compounds customary for corrosion prevention compositions, for example petroleum-sulfonates, mineral oils or other additives.

The corrosion prevention compositions according to the invention exhibit an emulsifying and corrosion-inhibiting action in aqueous metalworking compositions containing mineral oil. The invention therefore also relates to the use of the corrosion prevention compositions according to the invention in metalworking compositions, in particular aqueous metalworking compositions. As used herein, the term "metalworking compositions" refers to all fluids customary used in metalworking, in particular cooling lubricants, drilling, cutting and grinding oils and derusting, paint stripping and passivating compositions. With the corrosion prevention compositions according to the invention, it is possible to prepare metalworking emulsions which have a high water content without the formation of rust occurring. In addition to good corrosion prevention, the corrosion prevention compositions according to the invention are distinguished by an excellent skin tolerability and high biological degradability.

The corrosion-inhibiting action of the corrosion prevention compositions according to the invention was determined by means of the filings/filter paper method in accordance with "Deutsche Industrie Norm" (German Industrial Standard) DIN 51360, part 2.

The following examples are intended to illustrate the invention in further detail without limiting its scope.

EXAMPLES

1. Preparation Of Lactobionic Acid N-oleylamide 500 g of lactobionic acid lactone were finely ground in a mortar and then dissolved in portions in 1.6 liters of methanol at 50° to 60° C. 324.4 g of molten oleylamine were added to this solution, while stirring. This entire, still clear solution was stirred at room temperature for 1 hour and then left to stand for about 12 hours. A white precipitate separated and was filtered out, washed with methanol and then dried in a vacuum drying cabinet at 30° C. The yield was 93% by weight of lactobionic acid N-oleylamide, based on the lactobionic acid lactone.

Other lactobionic acid amides, such as lactobionic acid N-coconut amide or lactobionic acid N-tallow amide, were also prepared as described by way of example for lactobionic acid N-oleylamide.

2. Determination Of The Corrosion Prevention Properties

The corrosion prevention properties were determined in accordance with DIN standard 51360, part 2.

Grey cast iron filings (material about 5 mm×5 mm in size) were washed with petroleum ether, sieved through a wire sieve and dried at about 105° C. in a drying cabinet. After drying, hand contact with the filings was avoided.

A circular filter of filter paper (diameter 40 mm) was placed in a Petri dish and sprinkled uniformly with 2 g (±0.1 g) of the dried filings. The filings were then wetted uniformly, by means of a volumetric pipette, with 2 ml of the solution to be investigated. The lid was placed on the Petri dish and the Petri dish was left to stand at room temperature for 2 hours. The filings were then removed from the circular filter and the circular filter was rinsed under running water, swirled in acetone for about 5 seconds and dried at room temperature. Immediately after the circular filter had been cleaned and dried, the degree of corrosion of the corrosion traces on the circular filter was determined by visual examination. The degree of corrosion determined for the corrosion prevention compositions according to the invention is shown in the following table. For better evaluation, an experiment was carried out with only pure tap water without a further additive. The corrosion prevention action for a 3% strength aqueous solution of oleylamide, coconut amide and tallow amide prepared with tap water was determined in each case. In addition, a further series of experiments was also carried out, in which the pH was adjusted to pH 9.0 with triethanolamine.

TABLE 1

| | Degree of corrosion |
|---|---|
| Water | severe corrosion |
| Oleylamide 3% by weight in $H_2O$ | traces of corrosion |
| Coconut amide 3% by weight in $H_2O$ | no corrosion |
| Tallow amide 3% by weight in $H_2O$ | no corrosion |

TABLE 2

| | Degree of corrosion |
|---|---|
| Water, pH 9.0 | severe corrosion |
| Oleylamide, pH 9.0 3% by weight in $H_2O$ | slight corrosion |
| Tallow amide, pH 9.0 3% by weight in $H_2O$ | slight corrosion |
| Coconut amide, pH 9.0 3% by weight in $H_2O$ | moderate corrosion |

The foregoing results demonstrate that the corrosion prevention compositions according to the invention have corrosion prevention properties which comply with DIN standard 51360, part 2.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A corrosion inhibiting composition comprising 0.1 to 20% by weight lactobionic acid N-alkylamides, said composition further comprising at least one further corrosion inhibiting agent selected from the group consisting of petroleum sulfonates and mineral oils and having a pH below pH 9.0.

2. A corrosion inhibiting composition according to claim 1, wherein said lactobionic acid N-alkylamides comprise saturated or partly unsaturated alkyl groups having a chain length of 8 to 18 carbon atoms bonded via the amide function.

3. A corrosion inhibiting composition according to claim 2, wherein said lactobionic acid N-alkylamides are obtained by reaction of lactobionic acid or a reactive lactobionic acid derivative with a fatty amine mixture.

4. A corrosion inhibiting composition according to claim 1, wherein said lactobionic acid N-alkylamides are selected from the group consisting of lactobionic acid N-oleylamide, lactobionic acid N-coconut amide and lactobionic acid N-tallow amide.

5. A corrosion inhibiting composition according to claim 1, comprising lactobionic acid N-alkylamides in an amount of 1 to 10% by weight.

6. A corrosion inhibiting composition according to claim 1, wherein said composition comprises an aqueous solution of at least one lactobionic acid N-alkylamide.

* * * * *